United States Patent [19]

Imai

[11] Patent Number: 4,591,308

[45] Date of Patent: May 27, 1986

[54] GUIDE JIG FOR LIFTING AN OUTER WALL MEMBER OF A CURTAIN WALL

[75] Inventor: Tetsuji Imai, Kurobe, Japan

[73] Assignee: Yoshida Kogyo K. K., Tokyo, Japan

[21] Appl. No.: 634,152

[22] Filed: Jul. 25, 1984

[30] Foreign Application Priority Data

Jul. 29, 1983 [JP] Japan ..... 58-177066[U]

[51] Int. Cl.[4] ..... E04G 21/16

[52] U.S. Cl. ..... 414/11; 52/127.2; 52/745; 52/749; 187/2; 212/166; 414/589

[58] Field of Search ..... 414/10, 11, 12, 589; 187/2; 52/122.1, 127.2, 235, 745, 747, 749; 212/166

[56] References Cited

U.S. PATENT DOCUMENTS 3,791,094 2/1974 Shannon ..... 414/11 X

FOREIGN PATENT DOCUMENTS 1386294 12/1964 France ..... 414/11
55-132861 10/1980 Japan ..... 414/11
6809949 1/1970 Netherlands ..... 52/745
2107777 5/1983 United Kingdom ..... 52/749

*Primary Examiner*—Leslie J. Paperner
*Attorney, Agent, or Firm*—Hill, Van Santen, Steadman & Simpson

[57] ABSTRACT

A guide jig for lifting an outer wall member of a curtain wall is constructed principally of a nearly L-shaped arm having two legs extending in two directions making a predetermined angle therebetween. First and second brackets are connected to tip end portions of the respective legs of the arm so as to be rotatable about respective axes substantially perpendicular to a plane containing the arm, first and second sliders are fixedly secured to the first and second brackets, respectively, and a rope engaging member is provided at a tip end portion of one leg of the arm. Locking means for connecting or disconnecting the arm to or from a free end of one of the brackets is provided between the arm and the one bracket, and when the arm and the free end of the one bracket is connected to each other by the locking means, the first and second sliders are held apart from each other by a predetermined distance in the direction perpendicular to a lifting plane of the outer wall member, provided that they are kept directed nearly in the vertical direction.

4 Claims, 18 Drawing Figures

$9_2$
6
4
B''
$B_1$
6
$9_3$
47
12
B'
6
10
19
12
10
19

GUIDE JIG FOR LIFTING AN OUTER WALL MEMBER OF A CURTAIN WALL

BACKGROUND OF THE INVENTION (1) Field of the Invention

The present invention relates to a guide jig for lifting an outer wall member which is to be used upon mounting an outer wall member forming a curtain wall to a building body.

(2) Description of the Prior Art

A process for mounting a curtain wall unit, in which a building body is framed with steel frame members, a curtain wall unit serving as an outer wall member is transported up to a mounting position by lifting it with a crane installed on the roof or on the ground, and then the curtain wall unit is mounted to the building body, has been heretofore known.

According to this mounting process, since a curtain wall unit is simply lifted up with a crane, there were shortcomings that upon transporting the curtain wall unit up to a mounting position the transporting operation was dangerous and the operation of mounting the curtain wall unit to a building body was also difficult because the curtain wall unit moved as swinging.

Especially under a strong-wind condition, a great danger is encountered due to the fact that the curtain wall unit swings largely as fanned by strong wind, and eventually it may be turned over or may collide with a previously mounted curtain wall unit.

In addition, as disclosed in Japanese Laid-Open Patent Specification No. 55-132861, another mounting process has been known, in which a pair of guide wires are disposed along an outer wall surface of a building in parallel to each other and nearly in the vertical direction, and a curtain wall unit (a facing plate) is transported up to a mounting position by lifting it along the guide wires and is mounted to the outer wall surface of the building.

According to the last-mentioned mounting process, there is a merit that a curtain wall unit can be mounted safely because it does not move as swinging.

However, when this mounting process is employed, a curtain wall unit to be newly mounted must be transported by lifting up to a mounting position while paying attention so as not to interfere with already mounted curtain wall units, thereafter the curtain wall unit to be mounted must be drawn close to the building body to be mounted, so that the mounting operations are very troublesome, and often the curtain wall unit to be mounted may interfere with the already mounted curtain wall units, resulting in damage of the both curtain wall units.

SUMMARY OF THE INVENTION

It is therefore a principal object of the present invention to provide a guide jig to be used in a novel process for lifting an outer wall member in which difficulties inherent to the heretofore known processes for lifting an outer wall member of a curtain wall.

A more specific object of the present invention is to provide a guide jig for lifting an outer wall member of a curtain wall, which can guide a transporting operation of lifting an outer wall member to be mounted up to a mounting level simply and safely along guide rails without interfering with already mounted outer wall members and which enables to simply draw the outer wall member to be mounted from its lifted position close to a building body to connect it to the already mounted outer wall members.

According to one feature of the present invention, there is provided a guide jig for lifting an outer wall member of a curtain wall comprising a nearly L-shaped arm having two legs extending in two directions making a predetermined angle therebetween, first and second brackets connected to tip end portions of the respective legs of the arm so as to be rotatable about respective axes substantially perpendicular to a plane containing the arm, first and second sliders fixedly secured to the first and second brackets, respectively, a rope engaging member provided at a tip end portion of one leg of the arm, and locking means provided between the arm and one of the brackets for connecting or disconnecting the arm to or from a free end of the one bracket, whereby when the arm and the free end of the one bracket are connected to each other by the locking means, the first and second sliders are held apart from each other by a predetermined distance in the direction perpendicular to a lifting plane of the outer wall member, provided that they are kept directed nearly in the vertical direction.

According to another feature of the present invention,between the tip end portions of the legs of the arm and the first and second brackets, respectively, by a limited angle about axes in parallel to the first and second sliders, respectively.

According to still another feature of the present invention, there is provided the first-featured guide jig, in which the two legs of the arm extend in two directions making a predetermined obtuse angle therebetween.

According to a further feature of the present invention, there is provided the first-featured guide jig, in which when an outer wall member of a curtain wall is lifted up, the arm is disposed in such manner that the first bracket may be positioned at a higher level than the second bracket, the rope engaging member is provided at the tip end portion of the leg of the arm connected to the first bracket, and the locking means is provided between the arm and the first bracket.

The above-mentioned and other features and objects of the present invention will become more apparent by reference to the following description of a preferred embodiment of the invention taken in conjunction with the accompanying drawings.

DESCRIPTION OF A PREFERRED EMBODIMENT

Figure 1:
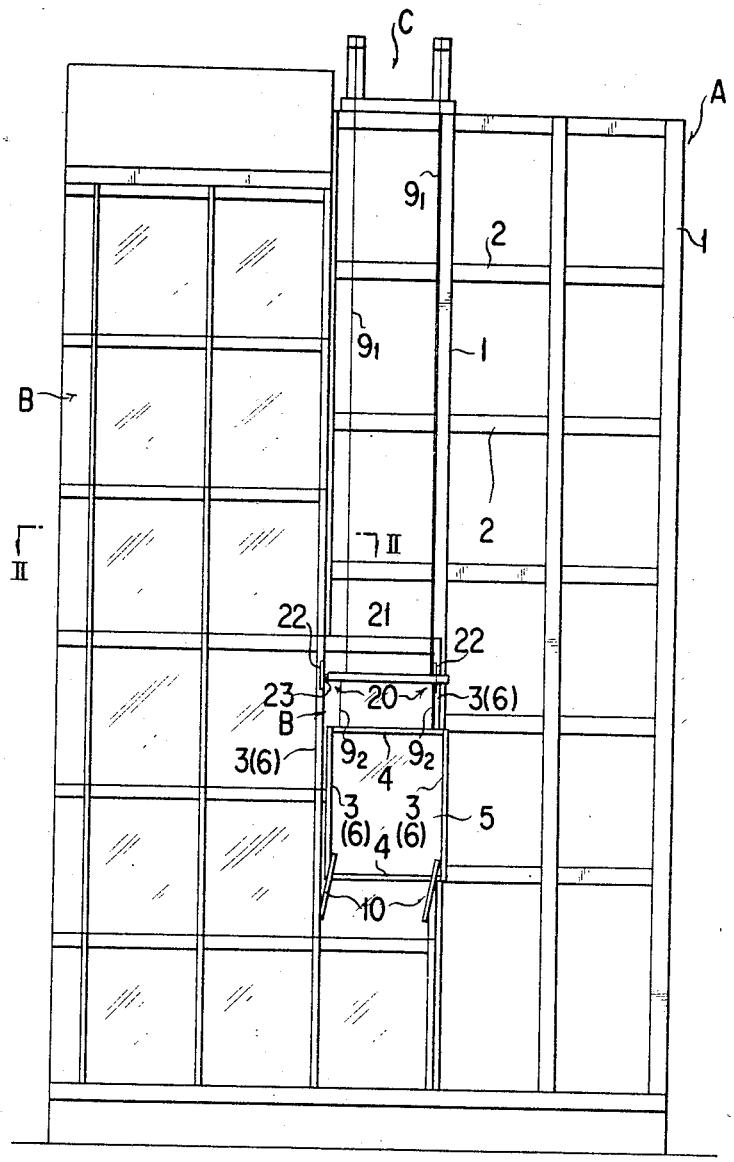
FIG. 1 is a schematic front view showing the state where a curtain wall unit is being mounted to a building body.
Figure 2:
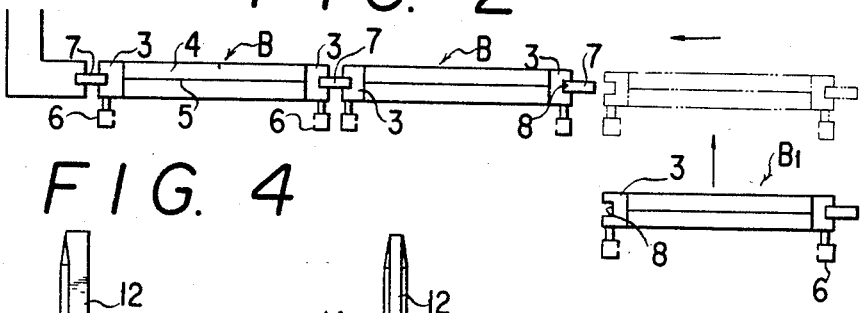
FIG. 2 is a cross-sectional view taken along line II—II in FIG. 1 as viewed in the direction of arrows.
Figure 10:
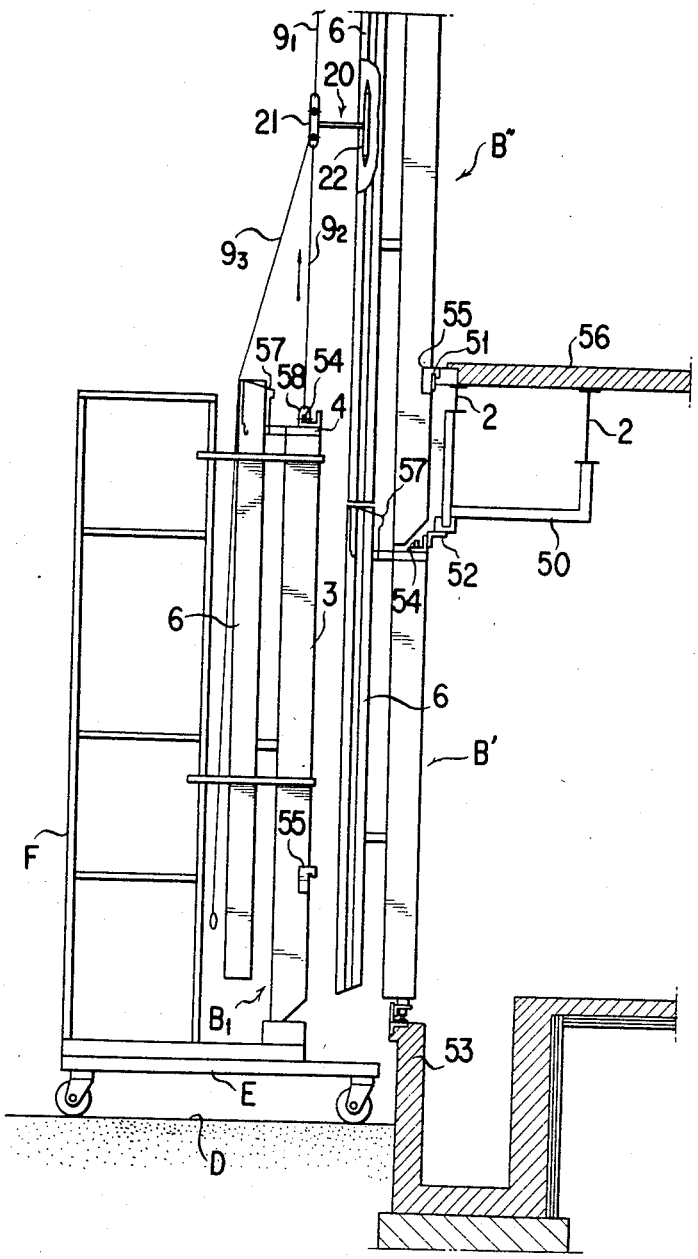

Referring now to FIGS. 1 and 2 which show the state where a curtain wall unit is being mounted to a building body, a building body A is a steel-frame body formed by framing steel stringers 1 and steel crossbeams 2, the steel crossbeams 2 are provided for each story, and as best shown in FIG. 10, a slab 56 forming a floor of each story is supported along the upper edges of the respective steel crossbeams 2.

A curtain wall unit B serving as the above-mentioned outer wall member is formed by framing a pair of vertical members 3, 3 and upper and lower horizontal members 4, 4 in a rectangular shape and fitting a panel member 5 such as a glass panel, a window panel, a heat-insulating panel, etc. in the frame work, and on the outdoor side of the abovementioned pair of vertical members 3, 3 are fixedly provided guide rails 6, 6 which extend in the vertical direction.

The guide rail 6 is a long member having a V-shaped transverse cross-section, and serves as a blind guide for vertically slidably guiding a blind not shown.

The curtain wall units B are successively mounted along one vertical column from the lowest level towards the highest level, thereafter they are again successively mounted along the adjacent vertical column from the lowest level towards the highest level, and a packing band 7 is equipped between and along the vertical members 3, 3 of the laterally adjacent curtain wall units B, B.

More particularly, as best seen in FIG. 2, the vertical member 3 is provided with a groove 8 opening outwardly within the plane of the curtain wall unit B, one edge portion of the packing band 7 is equipped in the groove 8 of the vertical member 3 of an already mounted curtain wall unit B, then a curtain wall unit $B_1$ to be mounted is moved in the plane of the curtain wall towards the already mounted curtain wall B, and thereby the other edge portion of the packing band 7 is fitted into the groove 8 of a vertical member 3 of the curtain wall unit $B_1$ to be mounted.

On the other hand, as shown in FIG. 1, a pair of left and right lower guides 10, 10 each consisting of a guide jig according to the present invention are mounted between the guide rails 6, 6 of the curtain wall unit $B_1$ to be mounted and the guide rails 6, 6 of the already mounted curtain wall unit B, on the respective guide rails 6, 6 of the already mounted curtain wall unit B are slidably mounted a pair of left and right upper guides 20, 20, respectively, also two main ropes $9_1$, $9_1$ of a crane C installed on the roof are connected to a connecting rod 21 which connects these left and right upper guides 20, 20 with each other, the connecting rod 21 and an upper horizontal member 4 of the curtain wall unit $B_1$ to be mounted are connected with each other via connecting ropes $9_2$, $9_2$, and so, by taking up the two main ropes $9_1$, $9_1$, by means of the crane C, the curtain wall unit $B_1$ to be mounted is lifted up along the guide rails 6, 6 of the already mounted curtain wall units B via the lower guides 10, 10 and the upper guides 20, 20. It is to be noted that if the connecting rod 21 is lifted up at its central portion, only a single main rope $9_1$ will suffice.

Figure 4:
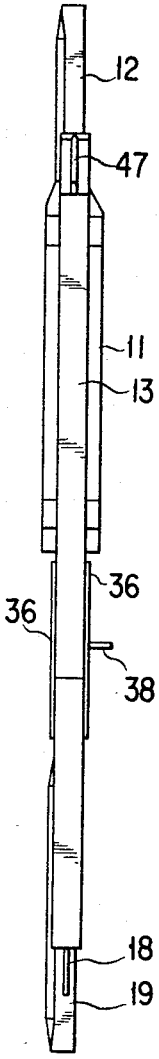
FIG. 4 is a front view of the same lower guide.
Figure 3:
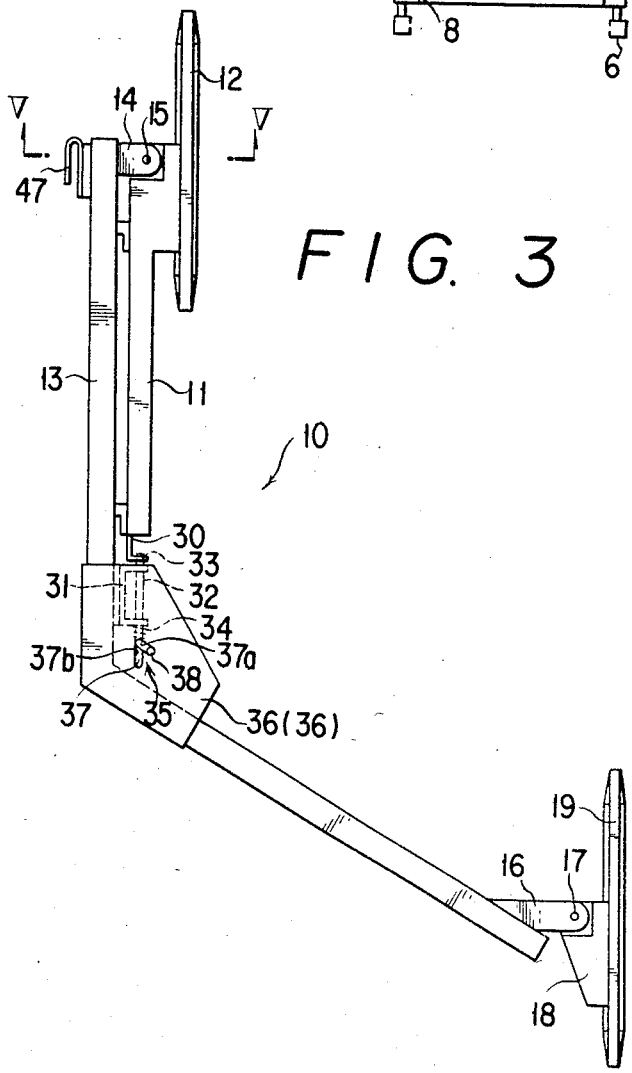
FIG. 3 is a side view of a lower guide.
Figure 5:
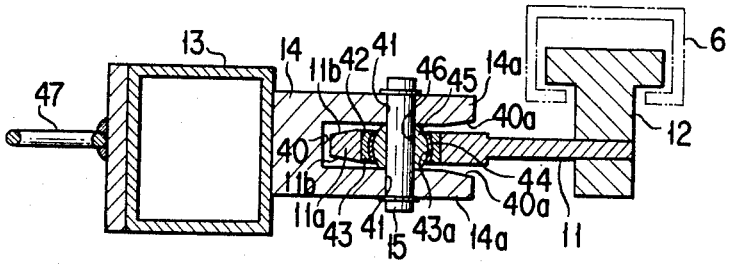
FIG. 5 is a cross-sectional view taken along line V—V in FIG. 3 as viewed in the direction of arrows.

With regard to the construction of each of the above-described lower guides 10, as shown in FIGS. 3, 4 and 5, a first slider 12 is fixedly secured to an upper portion of a first bracket 11 having an elongated plate shape, a top end portion of an arm 13 consisting of a hollow frame bent in a nearly obtuse-angled L-shape is rotatably connected to the first bracket 11 via a first holder 14 and a first pin 15, a second bracket 18 is rotatably connected to a bottom end portion of the arm 13 via a second holder 16 and a second pin 17, a second slider 19 is fixedly secured to this second bracket 18, an L-shaped receiver metal 30 having a hole 33 is fixedly secured to the bottom end portion of the first bracket 11, a lock pin 32 is vertically slidably inserted in a V-shaped frame 31 fixedly secured to the arm 13 in an opposed relation to the hole 33 of the receiver metal 30, this lock pin 32 is biased by a spring 34 towards a lower position (that is, an unlocking position) where it is drawn out of the hole 33, but can be held at an upper position (that is, a locking position) where its tip end fits in the hole 33 by means of a stopper mechanism 35, and thereby the lock pin 32, hole 33, spring 34 and stopper mechanism 35 jointly form locking means for connecting or disconnecting the arm 13 and the first bracket 11 to or from each other.

More particularly, with regard to the above-mentioned stopper mechanism 35, in one of a pair of side plates 36, 36 fixedly secured to the opposite sides of the arm 13 is formed an engaging slot 37 having a lateral branch slot 37*a* and a longitudinal main slot 37*b*, and a knob 38 formed by bending perpendicularly the bottom end portion of the lock pin 32 is engaged with this engaging slot 37.

Therefore, if the knob 38 is positioned in the lateral branch slot 37*a* of the engaging slot 37, then the knob 38 is urged against the lower edge of the lateral branch slot 37 by the above-mentioned spring 34, hence its downward movement is prevented, and thus the lock pin 32 is held in the above-described locking position, whereas if the know 38 is rotated about an axis of the lock pin 32 to be positioned in the longitudinal main slot 37*b*, then the lock pin 32 is depressed by a resilient force of the spring 34, so that the tip end of the lock pin 32 is disengaged from the hole 33 in the receiver metal 30 and thus the lock pin 32 is held in the above-described unlocking position.

Figure 6:
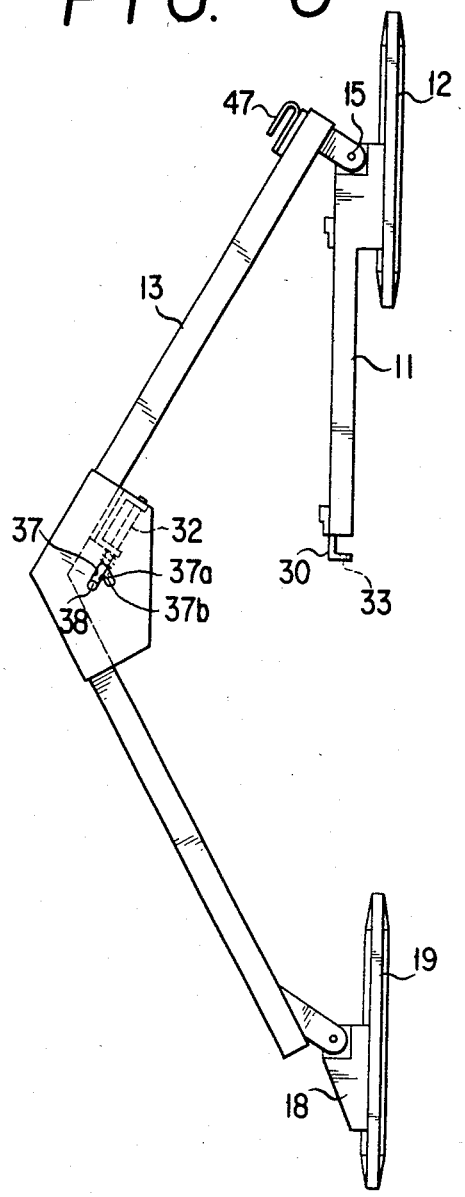
FIG. 6 is a side view of the same lower guide showing the state where connection between an arm of the lower guide and a free end of a first bracket is released.

The above-described first and second sliders 12 and 19 has a nearly T-shaped transverse cross-section adapted to slidably fit in the above-described guide rail 6, and in the state where the arm 13 and a free end, that is, the lower end of the first bracket 11 have been fixed to each other by fitting the lock pin 32 into the hole 33 in the receiver metal 30 as shown in FIG. 3, if the first slider and the second slider 19 are kept directed nearly in the vertical direction by the guide rails 6, 6, they are held apart from each other by a predetermined distance in the lateral direction as viewed in FIG. 3 (in the direction perpendicular to the plane along which the curtain wall is lifted up upon use of the guide jig 10), whereas in the state where the lock pin 32 has been drawn out of the hole 33 in the receiver metal 30, the first and second sliders 12 and 19 can be aligned in the vertical direction by rotating the arm 13 about the first pin 15 relatively to the first bracket 11 as shown in FIG. 6. It is to be noted that while locking means is provided so as to connect the arm 13 and the free end of the first bracket 11 in the illustrated embodiment, even if rocking means for connecting or disconnecting a free end of the second bracket 18 and the arm 13 to or from each other is provided in place of the illustrated locking means, obviously a similar effect can be achieved.

The above-mentioned first holder 14 which is fixedly secured to the top end of the arm 13, is connected to the first bracket 11 via a connecting structure as shown in FIG. 5.

Figure 7:
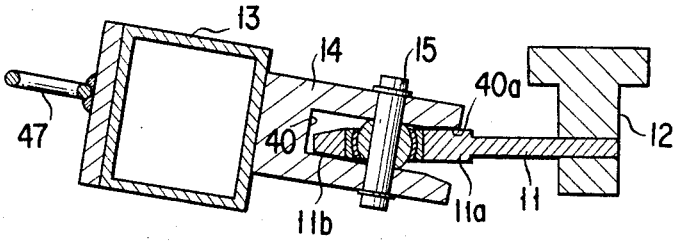
FIGS. 7 and 8 are cross-sectional views similar to FIG. 5 respectively showing the state where the first bracket and a first holder of the lower guide have been relatively angularly displaced in the opposite directions by a limited angle substantially within the horizontal plane.
Figure 8:
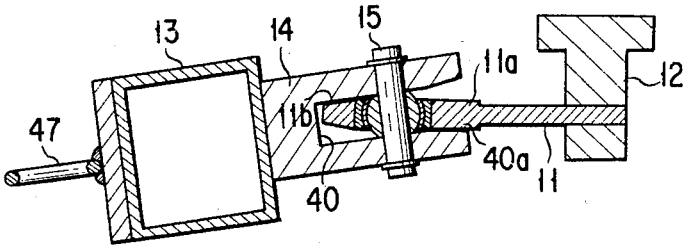

More particularly, the first holder 14 is provided with opposed side walls 14*a*, 14*a* delimiting a vertical channel 40 opening at the upper and lower end surfaces and one side surface, opposed inner surfaces 40*a*, 40*a* on the opening side of the vertical channel 40 are tapered surfaces diverging towards the opening side, a thick wall portion 11*a* at the rear of the first bracket 11 is placed within the vertical channel 40, a hole 42 opposed to holes 41, 41 formed in the respective side walls 14*a*, 14*a* is opened in the thick wall portion 11*a*, opposite side surfaces 11*b*, 11*b* at the rear end of the thick wall portion 11*a* are tapered surfaces converging towards the rearmost end, in the abovementioned hole 42 is fixedly fitted a ball holder 43, an inner peripheral surface 43*a* of this ball holder 43 is a spherical concave surface, in which a ball 45 is mounted via a slide plate 44 made of nylon, the first pin 15 is fitted in a hole 46 formed in the ball 45 and in the above-described holes 41, 41, and thereby the first holder 14 and the first bracket 11 can be connected so as to be relatively angularly displaceable until the tapered rear end side surface 11*b* of the first bracket 11 butts against the inner surface of the vertical channel 40 and the thick wall portion 11*a* butts against the opposed tapered inner surface 40*a* of the vertical channel as shown in FIGS. 7 and 8.

It is to be noted that though not shown, the second holder 16 and the second bracket 18 are connected via a similar connecting structure to that described above.

Figure 9:
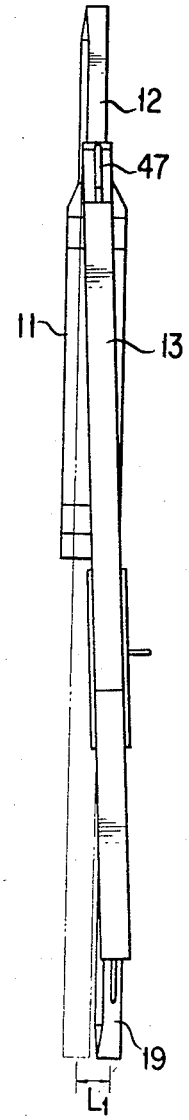
FIG. 9 is a front view showing the lower guide which is held in the state shown in FIG. 7, and FIGS. 10 through 18 are schematic side views showing successive steps in a process for mounting a curtain wall unit.

Owing to the above-described connecting structures, the first slider 12 and the second slider 19 can be displaced from each other by a distance $L_1$ in the horizontal direction while maintaining their vertical attitudes as shown in FIG. 9.

In addition, to the top portion of the arm 13 is fixedly secured a hook 47 for engaging with an auxiliary rope $9_3$ (that is, a rope engaging member).

Each of the above-mentioned pair of upper guides 20, 20 consists of a bracket 23 and a slider 22 mounted thereto, the respective brackets 23 are provided at the opposite ends of a connecting rod 21, and therefore, the pair of upper guides 20, 20 are interconnected by the connecting rod 21.

Now, description will be made on a process for mounting a curtain wall unit $B_1$ to be newly mounted, onto a building body A by means of guide jigs (lower guides) according to the present invention, sequentially with respect to the successive steps in the process.

As shown in FIG. 10, a preliminarily assembled curtain wall unit $B_1$ to be newly mounted is vertically placed on a mounting frame F of a carrier truck E which can freely travel along a ground surface D, and it is transported to a position faced to already mounted curtain wall units B by making the carrier truck E travel.

In FIG. 10, to a front edge of a slab 56 on a steel crossbeam 2 is fixedly secured a fastener 51, to an auxiliary body 50 fixed to the steel crossbeam 2 is fixedly secured a lower fastener 52, the bottom of the lowermost already mounted curtain wall unit B′ is connected onto a foundation 53, and the top of the same curtain wall unit B′ is connected to the lower fastener 52. Reference numeral 54 designates a pin.

The already mounted curtain wall units B″ at the second level and at higher levels are held in position with their brackets 55 engaged with the corresponding fasteners 51.

On the other hand, a pair of upper guides 20, 20 have their sliders 22 slidably mounted in the guide rails 6, 6 of the already mounted curtain wall units B″, and two main ropes $9_1$, $9_1$ are connected to the connecting rod 21.

And, the connecting rod 21 and the upper horizontal member 4 of the curtain wall unit $B_1$ to be mounted are connected with each other by the intermediary of a pair of connecting ropes $9_2$, $9_2$, then the curtain wall unit $B_1$ to be mounted is lifted above the mounting frame F by slightly taking up the two main ropes $9_1$, $9_1$ by means of the crane C, and the carrier truck E is retracted. It is to be noted that the connecting rope $9_2$ is fixedly secured to the pin 54 with the aid of a connecting metal 58.

Figure 11:
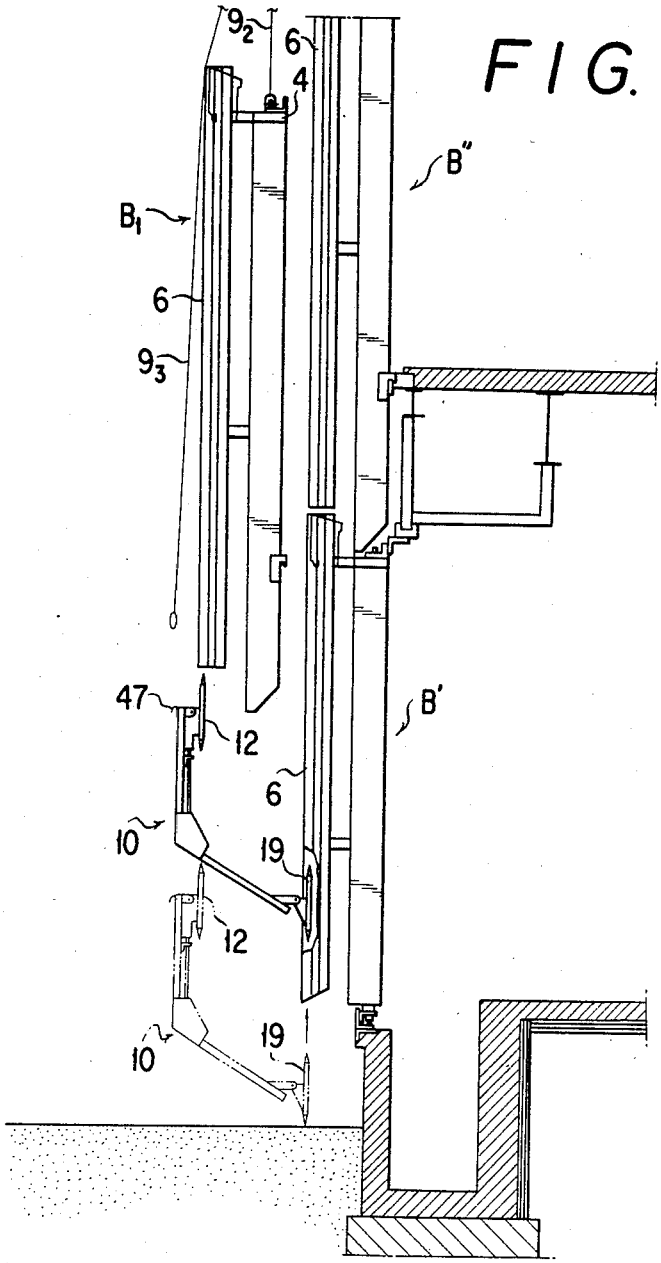

As shown in FIG. 11, the lower guides 10, 10 are prepared in the state shown in FIG. 3, their second sliders 19, 19 are inserted into the guide rails 6, 6 of the lowermost already mounted curtain wall unit B′ from the below and are slid upwardly along the guide rails 6, 6, also the first sliders 12, 12 are inserted into the guide rails 6, 6 of the curtain wall unit $B_1$ to be mounted from the below, then the auxiliary ropes $9_3$, $9_3$ are engaged with the hooks 47, 47 of the lower guides 10, 10, and thereby the lower guides 10, 10 are held in the above-described state via the auxiliary ropes $9_3$, $9_3$.

In other words, the lower guide 10 is suspended and supported by the auxiliary rope $9_3$ so as not to fall.

Figure 12:
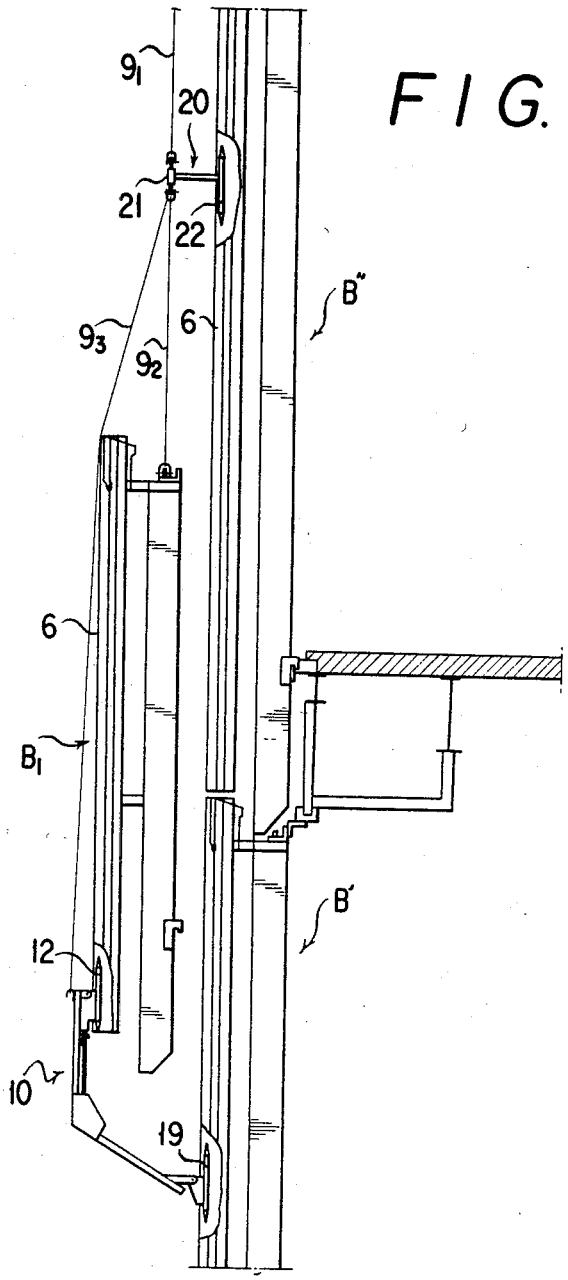

As shown in FIG. 12, the main ropes $9_1$, $9_1$ are taken up by the crane C, and while making the sliders 22, 22 of the upper guides 20, 20 and the second sliders 19, 19 of the lower guides 10, 10 slide along the guide rails 6, 6 of the already mounted curtain wall units B′, B″, the curtain wall unit $B_1$ to be mounted is transported upwardly as being lifted up. More particularly, the curtain wall unit $B_1$ to be mounted is lifted up by the connecting ropes $9_2$, $9_2$, and the lower guides 10, 10 are lifted up by the auxiliary ropes $9_3$, $9_3$. This state corresponds to the state shown in FIG. 1.

At this moment, since the first slider 12 and the second slider 19 are kept apart from each other by a predetermined distance in the direction perpendicular to the plane of lifting the curtain wall unit as shown in FIG. 3, the curtain wall unit $B_1$ to be mounted is held at a predetermined distance in the direction perpendicular to the plane of the curtain wall from the already mounted curtain wall units B′, B″, and therefore, the curtain wall unit $B_1$ to be mounted can be transported upwardly without interfering with the already mounted curtain wall units B′, B″ while large swinging in the horizontal direction of the curtain wall unit $B_1$ is prevented by the upper guides 20, 20 and the lower guides 10, 10.

It is to be noted that the center between the suspending positions by the upper guides 20, 20 (that is, the center position along the horizontal direction between the two main ropes $9_1$, $9_1$) is somewhat displaced rightwardly with respect to the center in the horizontal direction within the plane of the already mounted curtain wall units B′, B″, hence the curtain wall unit $B_1$ to be mounted is somewhat displaced rightwardly with respect to the already mounted curtain wall units B′, B″ as shown in FIG. 1, and thus, provision is made such that the vertical member 3 of the curtain wall unit $B_1$ to be mounted may not interfere with the packing band 7 equipped in the vertical member 3 of the already mounted curtain wall unit B as shown in FIG. 2.

To that end, provision is made such that the first slider 12 and the second slider 19 can be held apart from each other by a distance $L_1$ in the lateral direction as viewed in FIG. 9 owing to the previously described connecting structures including ball joints between the first and second holders 14, 16 and the first and second brackets 11, 18. In other words, the distance $L_1$ in FIG. 9 is chosen equal to a magnitude of lateral displacement within the plane of the curtain wall between the curtain wall unit $B_1$ to be mounted and the already mounted curtain wall unit B.

Figure 13:
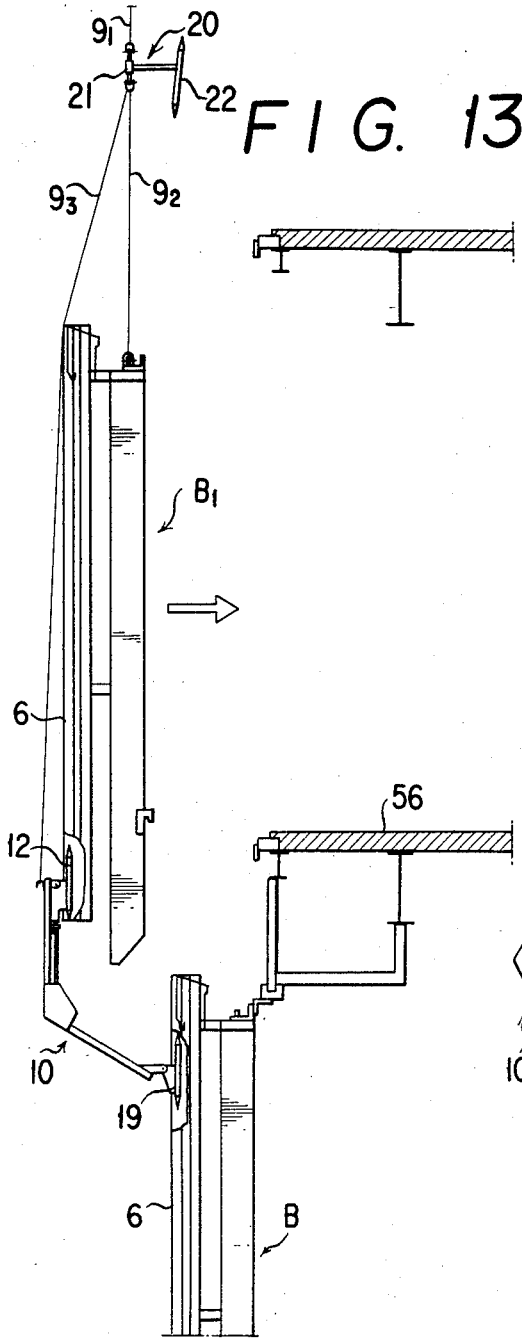

The curtain wall unit $B_1$ to be mounted is transported by lifting in the above-described manner, and when it has been lifted up and transported to a position a little above a mounting position as shown in FIG. 13, the crane C is stopped to cease the take-up operation of the main ropes $9_1$, $9_1$, and the curtain wall unit $B_1$ to be mounted is held at the position shown in FIG. 13.

At this moment, the sliders 22, 22 of the upper guides 20, 20 are disengaged from the guide rails 6, 6 of the already mounted curtain wall unit B, and positioned above the guide rails 6, 6.

Under the above-mentioned state, the stopper mechanism 35 of the lower guide 10 is operated to bring the lock pin 32 to the unlocking position, and thereby the first bracket 11 is made swingable with respect to the arm 13.

Figure 14:
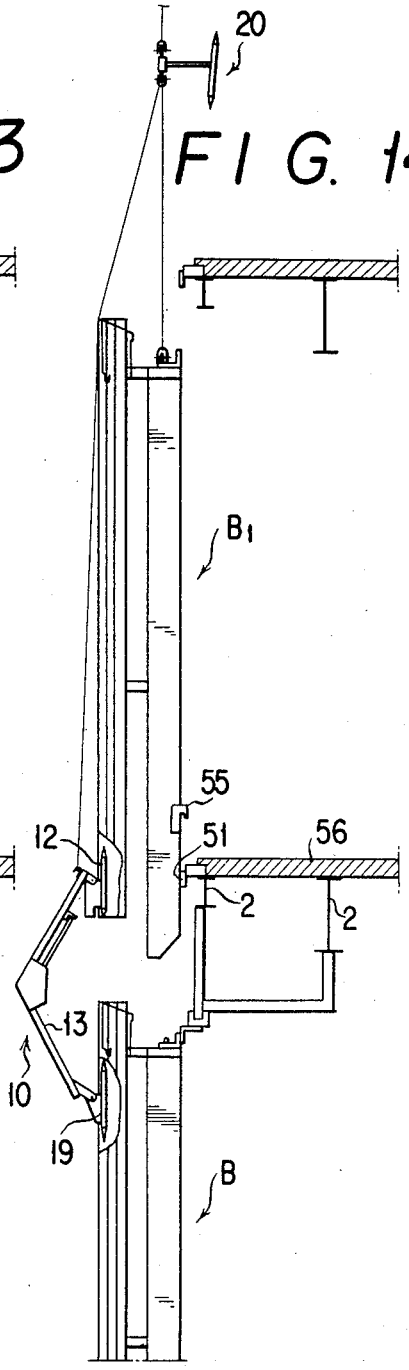

Thereafter, the curtain wall unit $B_1$ to be mounted is moved in the direction perpendicular to the plane of the curtain wall towards the indoor side (in the direction of an arrow) by the crane C, and the curtain wall unit $B_1$ to be mounted is brought to a position flush with the already mounted curtain wall units B as shown in FIG. 14.

At this moment, the lower guide 10 rotates about the second pin 17 so that the first slider 12 and the second slider 19 may take the positions aligned in the vertical direction as shown in FIGS. 6 and 14, and the bracket 55 is positioned above the fastener 51.

Starting from the state shown in FIG. 14, the curtain wall unit $B_1$ to be mounted is moved in one sideward direction (for instance, in the leftward direction as viewed from the front) in the plane of the curtain wall, and thereby the groove 8 of one vertical member 3 of the curtain wall unit $B_1$ is mounted by fitting to one edge portion of a packing band 7, the other edge portion of which is fitted in the groove 8 of the other vertical member 3 of the already mounted curtain wall unit B.

Figure 15:
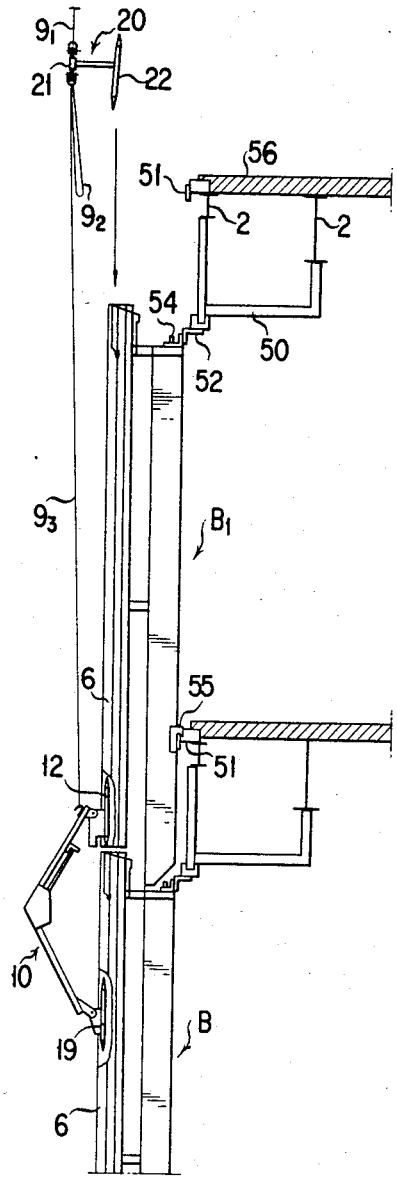

The main ropes $9_1$, $9_1$ are paid out by rewinding the crane C, thereby the curtain wall unit $B_1$ to be mounted is moved downwards to make the brackets 55, 55 engage with the corresponding fasteners 51, 51, subsequently the connecting ropes $9_2$, $9_2$ are disengaged from the pins 54, 54 by removing the connecting metals 58, 58, and the curtain wall unit $B_1$ to be mounted is fixedly mounted to the building body by fixing the same pins 54, 54 to the lower fasteners 52, 52 as shown in FIG. 15.

Thereafter, the main ropes $9_1$, $9_1$ are further paid out by further rewinding the crane C, thereby the upper guides 10, 10 and the lower guides 20, 20 are moved downwards, and while the first sliders 12, 12 of the lower guides 6, 6 are made to slide downwards along the insides of the guide rails 6, 6 of the already mounted curtain wall unit B, the sliders 22, 22 of the upper guides 20, 20 are inserted into the guide rails 6, 6 of the just mounted curtain wall unit $B_1$.

At this moment, the free ends of the connecting ropes $9_2$, $9_2$ are engaged with the connecting rod 21 between the upper guides 20, 20 so as not to hinder the operation.

Figure 16:
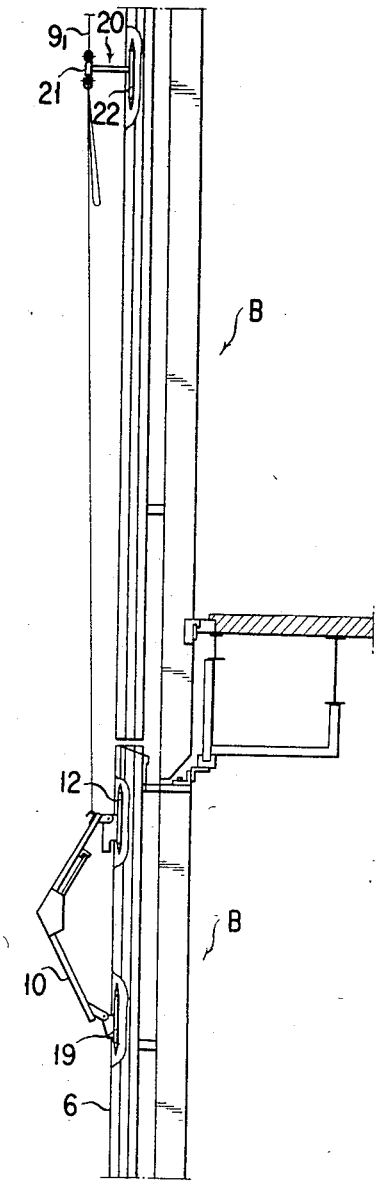

As shown in FIG. 16, the main ropes $9_1$, $9_1$ are paid out by rewinding the crane C, and the lower guides 10, 10 and the upper guides 20, 20 are lowered along the respective guide rails 6, 6 of the already mounted curtain wall units B.

Figure 17:
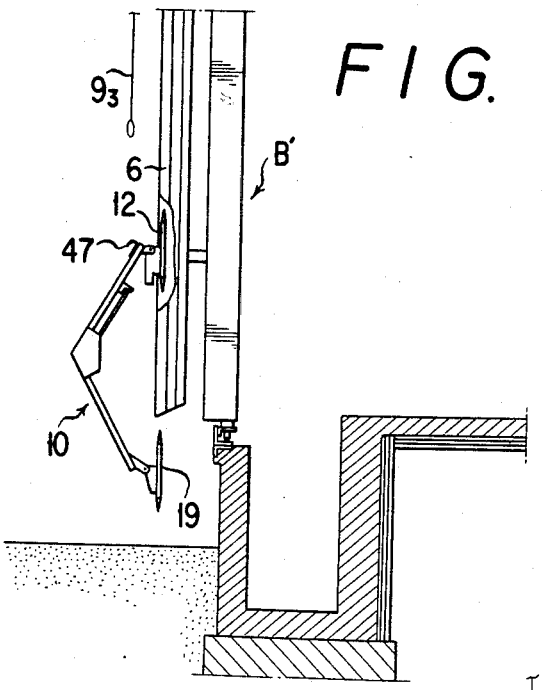

As shown in FIG. 17, when the lower guide 10 has lowered to the below of the guide rail 6 of the lowermost already mounted curtain wall unit B', the auxiliary rope $9_3$ is disengaged from the hook 47 of the lower guide 10, and the second slider 19 and the first slider 12 of the lower guide 10 are sequentially removed from the guide rail 6.

Figure 18:
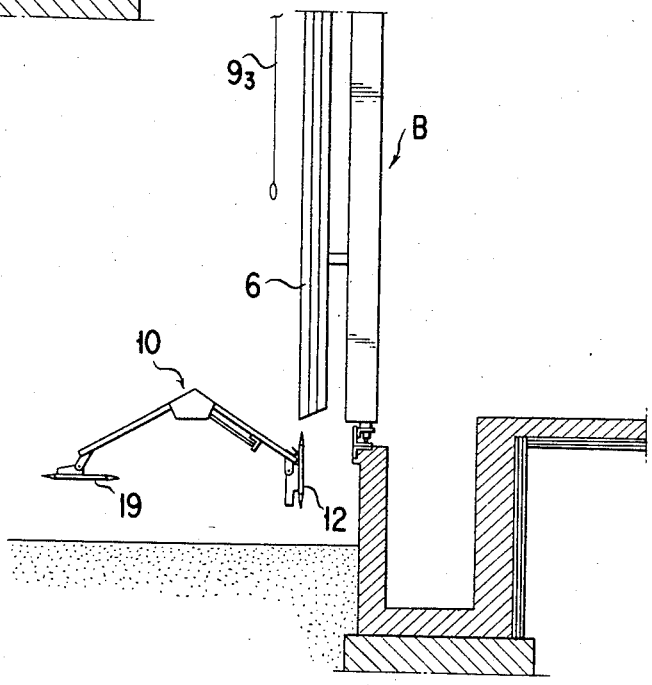

The state where the lower guide 10 has been removed from the guide rail 6 is as shown in FIG. 18, and in order to mount the next curtain wall unit $B_1$, it is only necessary to repeatedly carry out the operations illustrated in FIGS. 10 through 18.

As described above, with the guide jigs 10 according to the present invention, a curtain wall unit $B_1$ to be newly mounted can be mounted very safely and conveniently without being subjected to a swinging motion in the horizontal direction by making use of guide rails 6 of the already mounted curtain wall units B, and moreover, since the guide rails 6 extend as a result of mounting of a new curtain wall unit, the curtain wall units can be mounted simply without necessitating to provide special guide means or to frame a scaffolding.

It is to be noted that while the crane was installed on the roof in the above-described embodiment, the crane could be installed on the ground surface to lift up the curtain wall units.

As described above, in the lower guide 10 which is the guide jig for lifting an outer wall member of a curtain wall according to the present invention, the first and second sliders 12 and 19 can be held apart from each other by a predetermined distance in the direction perpendicular to the lifting plane of the curtain wall unit by connecting the arm 13 and the free end of the first bracket 11 to each other by the locking means with the lock pin 32 held at a locking position by the stopper mechanism 35, provided that the first and second sliders 12 and 19 are kept directed nearly in the vertical direction, whereas the first and second sliders 12 and 19 can be held at the positions aligned in the vertical direction by disconnecting the arm 13 from the free end of the first bracket 11 by the locking means with the lock pin 32 held at an unlocking position by the stopper mechanism 35. Therefore, upon lifting up the outer wall member (curtain wall unit) to be newly mounted, the outer wall member can be transported by lifting up to the mounting level smoothly, safely and simply while maintaining a predetermined interval between the outer wall member to be mounted and the already mounted outer wall members, and after it has been transported up to the mounting level, the outer wall member to be mounted can be simply and easily drawn close to the building body A.

More generally speaking, if the arm 13 and a free end of one of the brackets 11 or 18 are connected by the locking means, the first and second sliders 12 and 19 can be held apart from each other by a predetermined distance in the direction perpendicular to the lifting plane of the outer wall member, provided that they are kept directed nearly in the vertical direction, whereas if the connection between the arm 13 and a free end of one bracket 11 or 18 by the locking means is released, then the first and second sliders 12 and 19 can be brought to vertically aligned positions.

Accordingly, if the guide jigs according to the present invention are used, upon lifting up an outer wall member to be newly mounted to a building body along guide rails, it is possible to make the outer wall member to be separated from already mounted outer wall members and to guide the lifting transportion up to a mounting level while maintaining the interval therebetween, the outer wall member to be mounted is prevented from making contact with the already mounted outer wall members resulting in damage of the both outer wall members, and also the lifting transportion of the outer wall members can be achieved simply. In addition, the outer wall member to be mounted which has been transported up to the mounting level, can be simply drawn close to the building body (that is, the mounting plane of the curtain wall) by releasing the connecting between the arm and the free end of the bracket by the locking means, and thus the mounting operation of the outer wall member to be mounted can be carried out simply.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. A guide jig for lifting an outer wall member of a curtain wall comprising a nearly L-shaped arm having two legs extending in two directions making a predetermined angle therebetween, first and second brackets connected to tip end portions of the respective legs of said arm so as to be rotatable about respective axes substantially perpendicular to a plane containing said arm, first and second sliders fixedly secured to said first and second brackets, respectively, a rope engaging member provided at a tip end portion of one leg of said arm, and locking means provided between said arm and one of said brackets for connecting or disconnecting said arm to or from a free end of said one bracket, whereby when said arm and the free end of said one bracket are connected to each other by said locking means, said first and second sliders are held apart from each other by a predetermined distance in the direction perpendicular to a lifting plane of the outer wall member, provided that they are kept directed nearly in the vertical direction.

2. A guide jig as claimed in claim 1, in which the connecting structures between the respective legs of said arm and said first and second brackets, respectively, include ball joint structures which allow relative angular displacements between the tip end portions of the legs of said arm and the first and second brackets, respectively, by a limited angle about axes in parallel to said first and second sliders, respectively.

3. A guide jig as claimed in claim 1, in which the two legs of said arm extend in two directions making a predetermined obtuse angle therebetween.

4. A guide jig as claimed in claim 1, in which when an outer wall member of a curtain wall is lifted up, said arm is disposed in such manner that said first bracket may be positioned at a higher level than said second bracket, said rope engaging member is provided at the tip end portion of the leg of said arm connected to said first bracket, and said locking means is provided between said arm and said first bracket.

* * * * *